US005497709A

United States Patent [19]

Gonzalez et al.

[11] Patent Number: 5,497,709

[45] Date of Patent: Mar. 12, 1996

[54] PLASTIC PALLET ASSEMBLY

[75] Inventors: Nelson B. Gonzalez, Linden; Robert M. Wedge, New Baltimore, both of Mich.

[73] Assignee: Larry Winget, Leonard, Mich.

[21] Appl. No.: 331,062

[22] Filed: Oct. 28, 1994

[51] Int. Cl.[6] ..... B65D 19/12

[52] U.S. Cl. ..... 108/56.3; 108/902

[58] Field of Search ..... 108/51.1, 52.1, 108/53.1, 56.1, 56.3, 901

[56] References Cited

U.S. PATENT DOCUMENTS

| | | | |
|---|---|---|---|
| 3,824,933 | 7/1974 | Lind | 108/56.1 |
| 3,938,448 | 2/1976 | Nishitani et al. . | |
| 3,951,078 | 4/1976 | Fowler et al. . | |
| 3,954,067 | 5/1976 | Miles | 108/51.1 |
| 4,051,787 | 10/1977 | Nishitani et al. . | |
| 4,597,338 | 7/1986 | Kreeger . | |
| 4,635,562 | 1/1987 | Kreeger | 108/56.1 |
| 4,843,976 | 7/1989 | Pigott et al. . | |

*Primary Examiner*—Peter M. Cuomo
*Assistant Examiner*—Gerald Anderson
*Attorney, Agent, or Firm*—Brooks & Kushman

[57] ABSTRACT

A load-bearing pallet assembly comprises a resilient polymeric core including top and bottom halves which have means for interconnecting and easily disconnecting the halves but only when desired. The top half includes a top support panel having top corners, a flange portion which extends about the periphery of the top support panel and projects downwardly therefrom and a set of four tabs projecting downwardly from the top support panel at each of the top corners. The bottom half includes a base having bottom corners, a shoulder portion which extends about the periphery of the base and projects upwardly therefrom, and a boss shaped like a truncated pyramid which projects upwardly from the base at each of the bottom corners. Each of the bosses has a square slot for receiving four tabs of the top half to interconnect the top and bottom halves. The bottom half also includes head portions which project upwardly from the shoulder portion at each of the bottom corners and at midpoints therebetween. The top half also includes channels defined by pairs of spaced legs extending downwardly from the flange portion at each of the top corners and at intermediate positions therebetween for receiving the head portions to define corner and intermediate joints. The corner joints enclose and protect their respective bosses at the corners of the assembly. The intermediate joints protect spaced support members projecting outwardly from the base and complementarily-spaced support pads projecting downwardly from the top support panel at intermediate positions between adjacent corners of the assembly.

17 Claims, 4 Drawing Sheets

PLASTIC PALLET ASSEMBLY

TECHNICAL FIELD

This invention relates to load-bearing pallet assemblies and, in particular, to load-bearing plastic pallet assemblies.

BACKGROUND ART

Wooden pallets have long been used for handling material. Wooden pallets are relatively cheap, simple, and durable. However, wooden pallets are relatively heavy and require costly hand labor in their fabrication.

Generally, plastic pallets can be easily molded and are relatively stronger and lighter in weight than wooden pallets. Furthermore, in general, plastic pallets are more durable than wooden pallets.

A number of plastic pallets have been proposed. For example, U.S. Pat. No. 3,951,078 discloses a unitary plastic pallet.

U.S. Pat. Nos. 4,051,787 and 3,938,448 both disclose plastic pallets having top and bottom halves which are heat-fused or adhesively connected together.

U.S. Pat. No. 4,843,976 discloses a plastic pallet including a pair of identical frame members or decks that are interconnected by specially designed connectors. The connectors include flexible tangs that have barbs which engage abutments on the frame members that are recessed below the exposed surfaces thereof so that the connectors can be snap-fitted onto the frame members.

U.S. Pat. No. 4,597,338 discloses a plastic pallet having identical upper and lower pallet halves. Each pallet half is formed with a rigid rectangular load-supporting platform having symmetrically disposed rows of supporting posts and latching leg assemblies projecting vertically from one surface of its platform. The legs on one pallet half can be inserted into posts of the other to snap-lock the two halves together. Spaced skirt portions along each edge of the platforms engage those of the other pallet half to define forklift tine receiving openings in each side of the pallet.

While a number of plastic pallets have been proposed, these proposed solutions have not been widely accepted and there remains a need for a plastic pallet that is relatively inexpensive, light in weight, durable, capable of supporting heavy loads, is easy to assemble and disassemble, and has a minimum number of parts.

SUMMARY OF THE INVENTION

An object of the present invention is to provide a durable, load-bearing, plastic pallet assembly comprising a resilient polymeric core having top and bottom halves wherein the top and bottom halves are easily interconnected and only disconnected when desired.

In carrying out the above object and other objects of the present invention, a load-bearing plastic pallet assembly includes a resilient polymeric core having top and bottom halves. The top half includes a top support panel having top corners, a flange portion extending about the periphery of the top support panel and projecting downwardly therefrom and at least one tab projecting downwardly from the top support panel at each of the top corners. The bottom half includes a base having bottom corners, a shoulder portion extending about the periphery of the base and projecting upwardly therefrom, and a boss projecting upwardly from the base at each of the bottom corners. Each of the bosses has a slot for receiving its at least one tab of the top half to interconnect the top and bottom halves. The bottom half also includes a corner head portion projecting upwardly from the shoulder portion at each of the bottom corners. The top half also includes a corner channel defined by a pair of spaced corner legs extending downwardly from the flange portion at each of the top corners for receiving its respective corner head portion. Each pair of spaced corner legs is supported on a top surface of the shoulder portion. Each pair of spaced corner walls and its respective received head portion define a corner joint which encloses and protects its respective boss at a corner of the pallet assembly.

Preferably, a plurality of spaced mounds are formed about the periphery of a top surface of the top panel and a plurality of complementarily-shaped and spaced dimples are formed about the periphery of a bottom surface of the base so that two or more pallet assemblies can be stacked in locking arrangement at the dimples and the mounds.

Also preferably, the bottom half includes an intermediate head portion projecting upwardly from the shoulder portion between each pair of adjacent bottom corners and wherein the top half further includes an intermediate channel defined by pairs of spaced intermediate legs extending downwardly from the flange portion between each pair of adjacent top corners for receiving its respective intermediate head portion. Each pair of spaced intermediate walls and its respective received intermediate head portion define an intermediate joint wherein tine-receiving holes are defined in the assembly between the flange portion and the shoulder portion between adjacent pairs of corner and intermediate joints.

Still preferably, the bottom half includes a plurality of spaced support members projecting upwardly from the base and wherein the top half further includes a plurality of complementarily spaced support pads projecting downwardly from the top support panel. The support members support the top support panel at the support pads and the intermediate joints protect the support pads and support members at intermediate positions between adjacent corners of the assembly.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
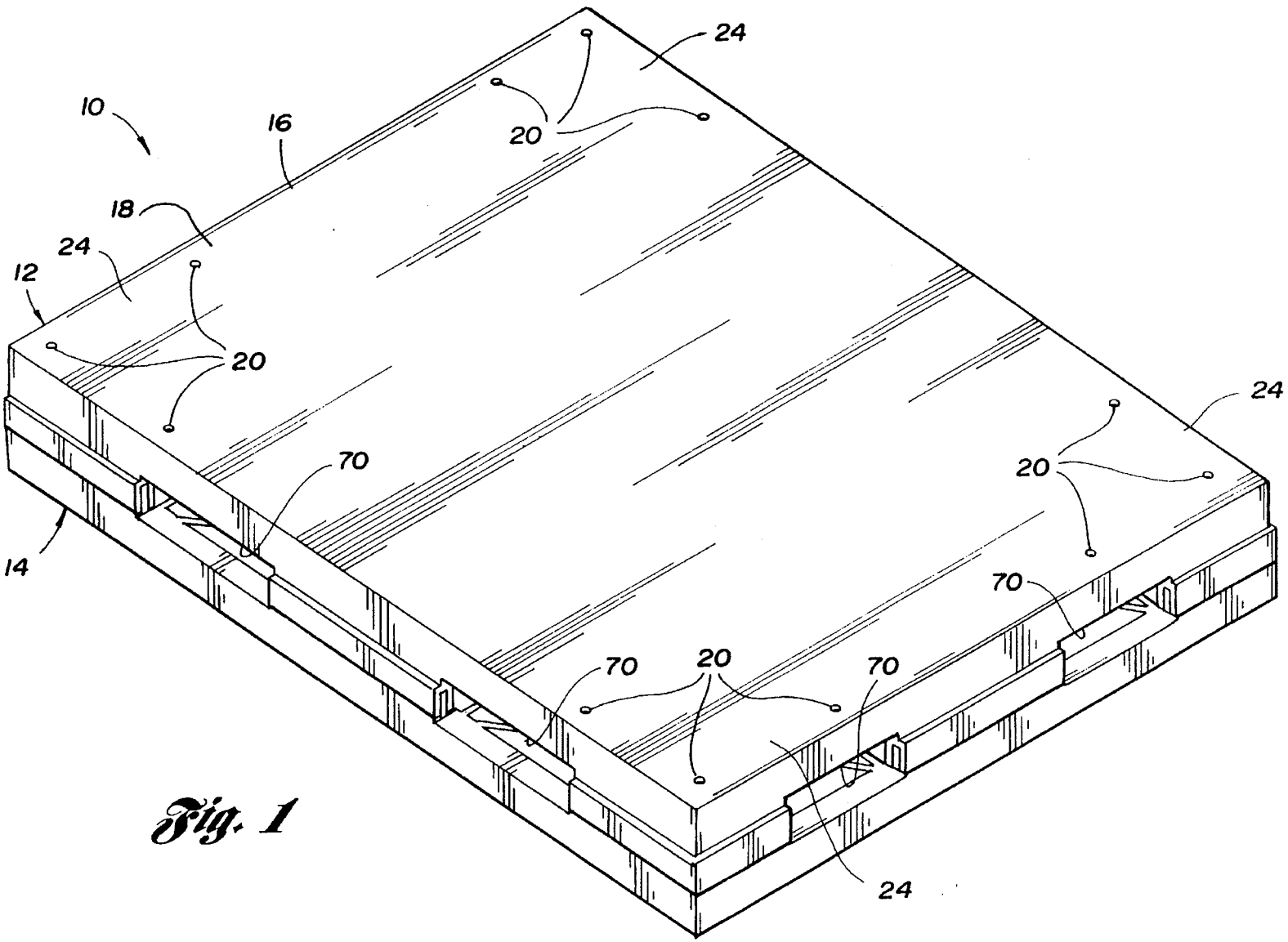
FIG. 1 is a perspective view illustrating a load-bearing plastic pallet assembly constructed in accordance with the present invention.

Referring now to the drawing figures, there is illustrated in FIG. 1 a load-bearing plastic pallet assembly, generally indicated at 10. The pallet assembly 10 generally comprises a resilient polymeric core having top and bottom halves generally indicated at 12 and 14, respectively. Each of the top and bottom halves 12 and 14 is integrally molded of a resilient polymeric material such as polypropylene. In particular, the polypropylene is preferably extra-strength, filled polypropylene.

The top half 12 includes a top support panel 16 with a top surface 18 on which a load such as cartons or crates of bottles or cans is supported. The top surface 18 of the top support panel 16 is grained or marked to increase the frictional characteristics of the top surface 18.

Figure 5:
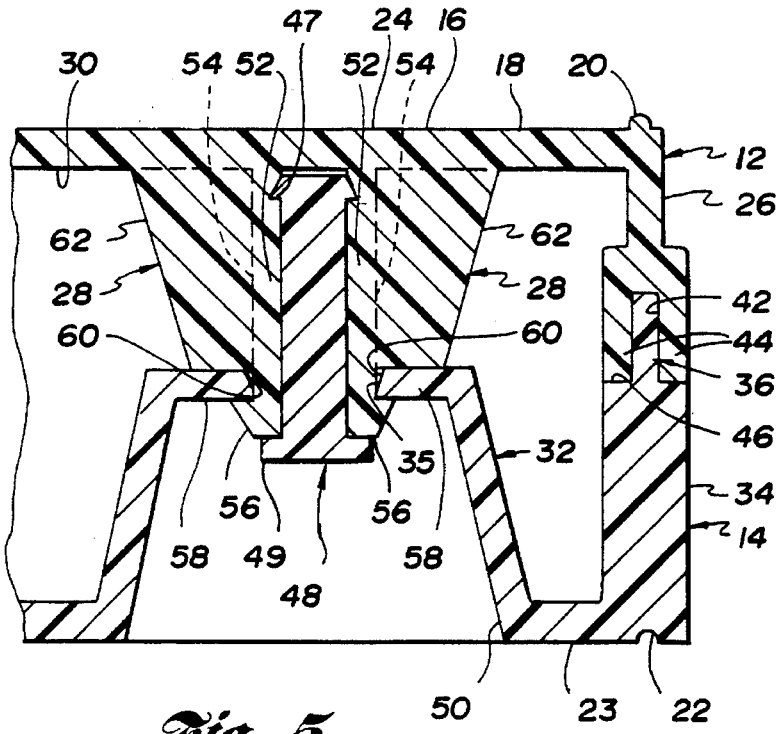
FIG. 5 is an enlarged sectional view partially broken away and in cross-section taken along the lines 5—5 in FIG. 2.

Referring also to FIG. 5, a plurality of spaced mounds 20 are formed about the outer periphery on the top surface 18 to help maintain the load on the top panel 16 and also to provide the male parts of male/female connections when a second identical pallet assembly is stacked on the top surface 18 of the pallet assembly 10. Female parts of the male/female connections are provided by dimples 22 formed about the outer periphery on the bottom surface of a base 23 of the bottom half 14. The male/female connections provided by the mounds 20 and the dimples 22 are sufficient to hold a stack of such pallet assemblies together, yet at the same time, allow a pallet assembly 10 to be removed from such a stack upon receiving a sufficient lateral force.

Figure 2:
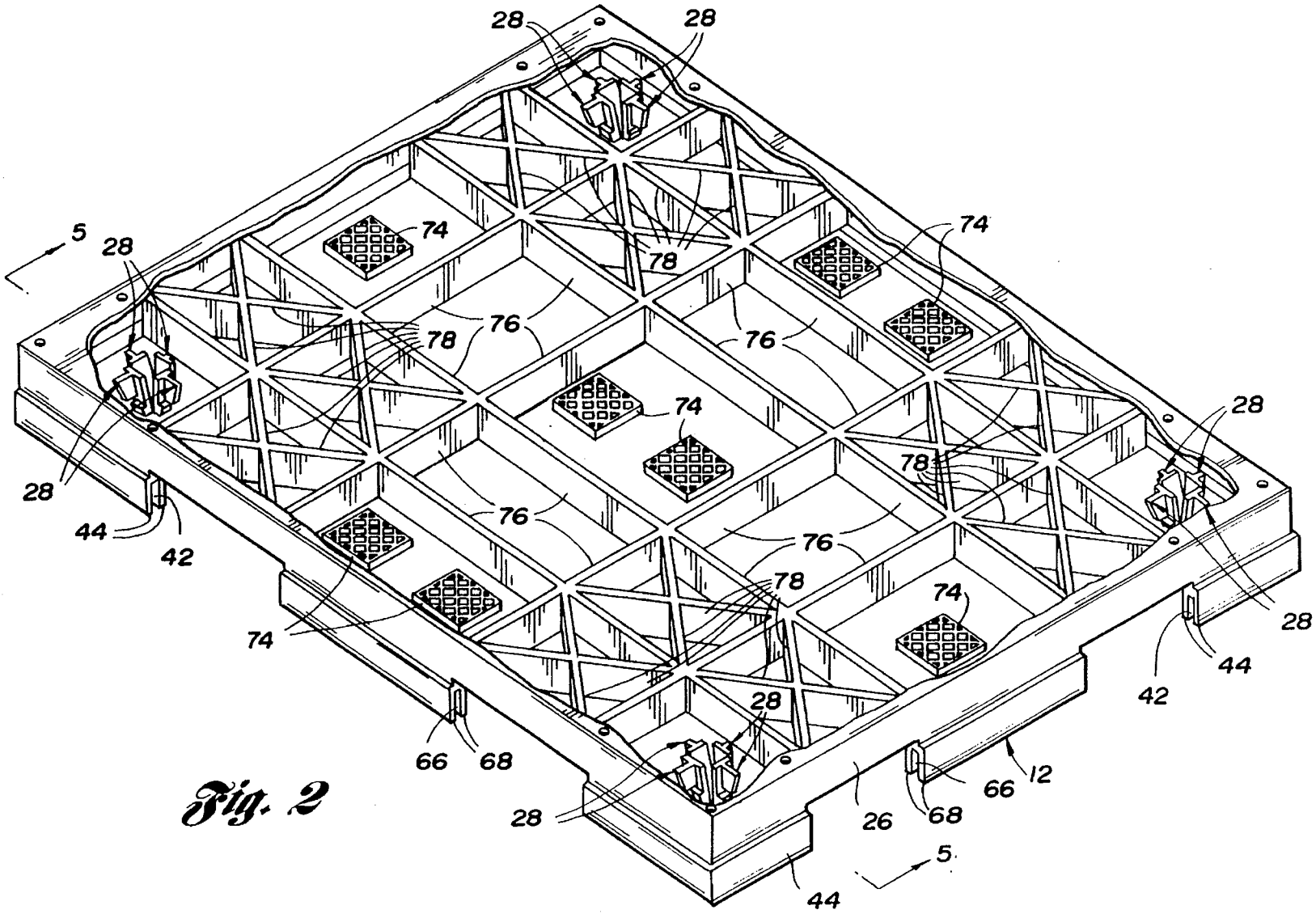
FIG. 2 is a perspective view of a top half of the pallet assembly of FIG. 1 with a top support panel thereof removed to illustrate the construction of the top half.

Referring now to FIGS. 2 and 5, the top half 12 also includes top corners 24 and a flange portion 26 which extends about the periphery of the top support panel 16 and projects downwardly therefrom. A set of four locking tabs, each of which is generally indicated at 28, projects downwardly from a lower surface 30 of the top panel 16 at each of the top corners 24.

Figure 3:
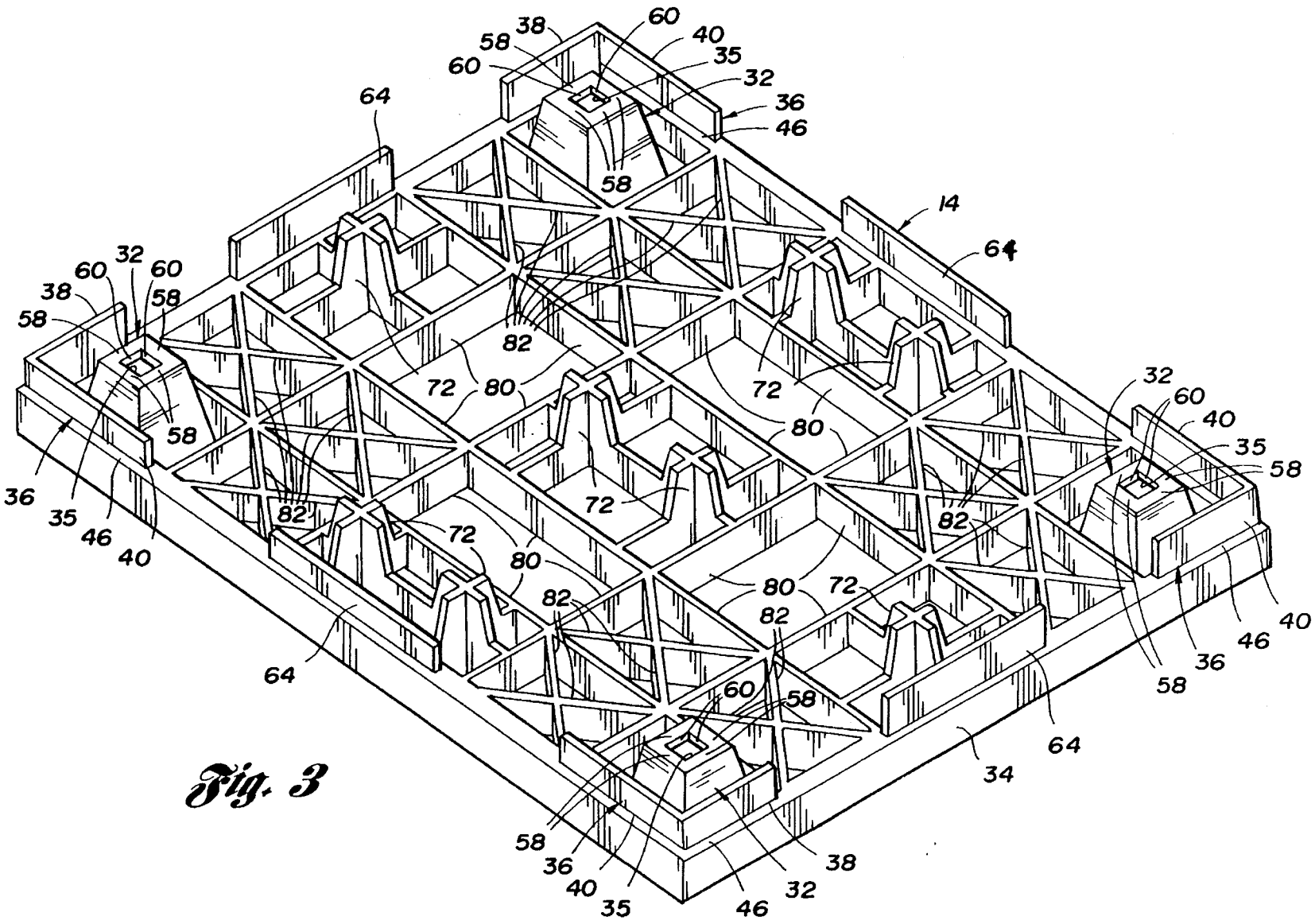
FIG. 3 is a perspective view of a bottom half of the pallet assembly of FIG. 1.

Each set of four tabs 28 lock within a boss, generally indicated at 32, formed at bottom corners of the base 23 as illustrated in FIG. 3. Each of the bosses 32 has a slot 35 for receiving its respective tabs 28 to interconnect the top and bottom halves 12 and 14, respectively.

The bottom half 14 also includes a shoulder portion 34 which extends about the periphery of the base 23 and projects upwardly therefrom. An L-shaped corner head portion, generally indicated at 36, projects upwardly from the shoulder portion 34 at each of the bottom corners of the bottom half 14. Preferably, each corner head portion 36 includes legs 38 and 40 which form a right angle.

Referring again to FIGS. 2 and 5, the top half 12 also includes a corner channel 42 defined by a pair of spaced, I,-shaped corner legs 44 which extend downwardly from the flange portion 26 of the top half 12 at each of the top corners. The corner channels 42 receive their respective corner head portions 36 so that each pair of spaced corner legs 44 are supported on a top surface 46 of the shoulder portion 34.

Each pair of spaced corner walls 44 and its respective received corner head portion 36 define a corner joint which encloses and protects its respective boss 32 at a corner of the assembly 10.

Each of the tabs 28 is flexible so that the tabs 28 releasably interconnect the top and bottom halves 12 and 14, respectively. Four locking pins, one of which is generally indicated in FIG. 5 at reference numeral 48, are provided for locking the tabs 28 in their respective bosses 32. Each locking pin 48 is in the form of a spool having upper locking barbs 47 and a lower enlarged diameter portion 49. Each pin 48 extends through a slot 35 of its respective boss 32 to secure its tabs 28 within its respective slot 35 at each of the bottom corners.

When it is desired to disconnect the top and bottom halves 12 and 14, the locking pins 48 are removed through apertures 50 formed in the base 23 and a tool (not shown) is utilized to radially move the tabs 28 inwardly toward a central longitudinal axis of the boss 32 to permit the tabs 28 to be removed through their slots 35.

Figure 4:
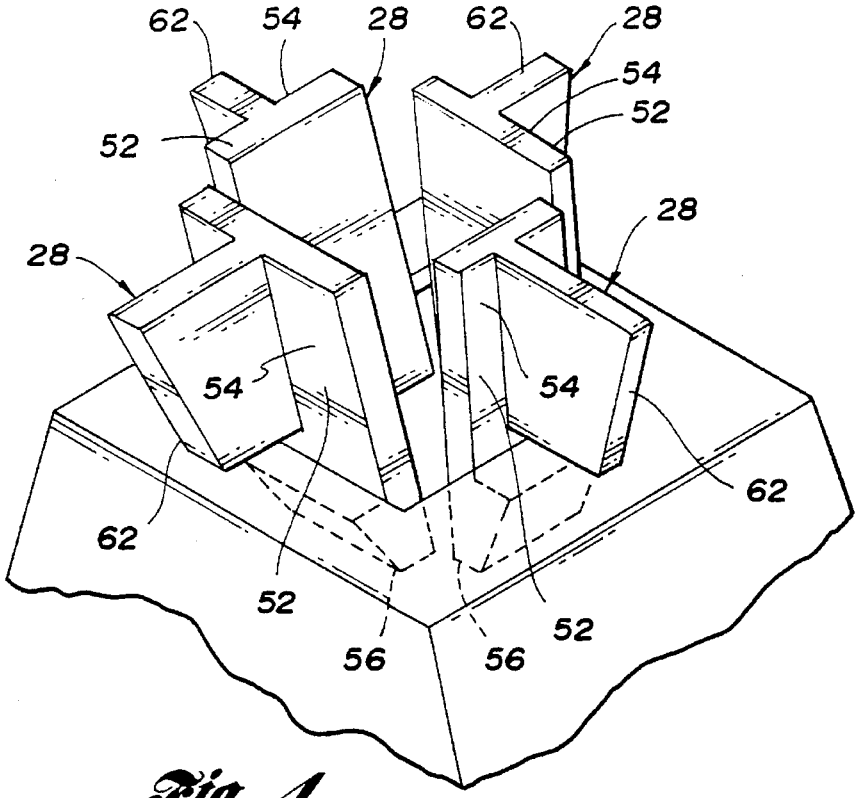
FIG. 4 is an enlarged perspective view of one set of locking tabs and its associated boss prior to interlocking engagement therebetween.

Referring now to FIGS. 4 and 5, each of the tabs 28 includes a shank 52 having a planar surface 54 and a tang 56 formed at a free end of each of the tabs 28. Each of the tabs 28 also includes an outwardly radially extending support flange 62 which defines an undercut with its respective tang 56 and the planar surface 54 of its respective shank 52.

Each of the bosses 32 includes four flanges 58, each of which has a rectangular surface 60 directed to the central longitudinal axis of the boss 32. Each set of four tabs 28 is snapped into its respective slot 35 by the momentary yielding of the tabs 28 as they are pushed into their respective slot 35. Each undercut engages and is retained by its respective flange 58 with the surface 60 of each flange 58 being closely adjacent to the planar surface 54 of its shank 52 to connect the top and bottom halves 12 and 14, respectively, together.

Referring now to FIG. 3, the bottom half 14 of the pallet assembly 10 further includes an intermediate head portion 64 which projects upwardly from the shoulder portion 34 between each pair of adjacent bottom corners.

Referring to FIG. 2, the top half 12 of the pallet assembly 10 also includes an intermediate channel 66 defined by a pair of spaced intermediate legs 68 extending downwardly from the flange portion 26 between each pair of adjacent top corners 24 for receiving its respective intermediate head portion 64. Each pair of spaced intermediate walls 68 and its respective received intermediate head portion 64 define an intermediate joint. In this way, tine-receiving holes 70, as illustrated in FIG. 1, are formed in the assembly 10 between the flange portion 26 and the shoulder portion 34 between adjacent pairs of corner and intermediate joints.

The intermediate joints formed by the interconnected intermediate walls 68 and intermediate head portions 64 protect tapered, spaced support members 72 which project upwardly from the base 23 and a plurality of complementarily-spaced support pads 74 projecting downwardly from the lower surface 30 of the top support panel 16. Preferably, the support members are cross-shaped in cross-section and support the top support panel 16 at the support pads 74.

The top half 12 of the pallet assembly 10 also includes a plurality of interconnecting inner plastic support members 76 and crossing support members 78 to provide structural integrity to the upper half 12.

In like fashion, the bottom half 14 of the pallet assembly 10 includes a plurality of inner interconnecting plastic support members 80 and crossing plastic support members 82 to provide structural integrity to the bottom half 14.

The advantages accruing to the plastic pallet assembly 10 constructed in accordance with the present invention are numerous. For example, each intermediate and corner joint formed by a pair of spaced walls and its respective received head portion provides three layers of interlocking protection for its respective boss or support structure. Each corner joint also resists lateral displacement of the top and bottom halves 12 and 14, respectively, in two dimensions. This is important since the tines of a fork-lift truck oftentimes hit the sides of pallets and, if of sufficient force, will pierce or otherwise deform corner and intermediate portions of a plastic pallet. If these portions are damaged, the means by which the top and bottom halves of plastic pallets are interconnected, as well as any structure supporting a top surface of the pallet, will oftentimes also be damaged. For example, if one or more of the support member 72 or the supports pads 74 are damaged, the top support panel 16 of the top half 12 will sag at those locations, thereby detracting from the overall utility of the pallet assembly 10.

While the best mode for carrying out the invention has been described in detail, those familiar with the art to which this invention relates will recognize various alternative designs and embodiments for practicing the invention as defined by the following claims.

What is claimed is:

1. A load-bearing, plastic pallet assembly comprising:

a resilient polymeric core having top and bottom halves, the top half including a top support panel having top corners, a flange portion extending about a periphery of the top support panel and projecting downwardly from said panel periphery and at least one tab projecting downwardly from the top panel at each of the top corners, the bottom half including a base having bottom corners, a shoulder portion extending about a base periphery of the base and projecting upwardly from said base periphery and a boss projecting upwardly from the base at each of the bottom corners, each of the bosses having a slot for receiving at least one tab of the top half securing the top and bottom halves together, wherein the bottom half also includes a corner head portion projecting upwardly from the shoulder portion at each of the bottom corners and wherein the top half also includes a corner channel defined by a pair of spaced corner legs extending downwardly from the flange portion at each of the top corner channels receiving a respective bottom corner head portion, each pair of spaced corner legs being supported on a top surface of the shoulder portion, and wherein each pair of spaced corner legs and the respective corner head portion define a corner joint which encloses and protects a respective boss and tab connection at a corner of the pallet assembly.

2. The assembly as claimed in claim 1 wherein the at least one tab at each of the top corners is flexible.

3. The assembly as claimed in claim 2 wherein the at least one tab at each of the top corners releasably interconnects the top and bottom halves.

4. The assembly as claimed in claim 3 further comprising a plurality of locking pins wherein each of the locking pins extends through the slot of the respective boss t,D secure the at least one tab within the respective slot at each of the bottom corners.

5. The assembly as claimed in claim 1 wherein each pair of spaced corner legs and their respective received corner head portion are L-shaped.

6. The assembly as claimed in claim 1 wherein the bottom half further includes an intermediate head portion projecting upwardly from the shoulder portion between each pair of adjacent bottom corners and wherein the top half further includes an intermediate channel defined by a pair of spaced intermediate legs extending downwardly from the flange portion between each pair of adjacent top corners for receiving the respective intermediate head portion, wherein each pair of spaced intermediate legs and the respective received intermediate head portion define an intermediate joint wherein tine-receiving holes are defined in the assembly between the flange portion and the shoulder portion between adjacent pairs of corner and intermediate joints.

7. The assembly as claimed in claim 1 wherein a plurality of spaced mounds are formed about the periphery of a top surface of the top panel and a plurality of complimentarily-shaped and spaced dimples are formed about the periphery of a bottom surface of the base so that two or more aligned assemblies can be stacked in locking engagement at the dimples and the mounds.

8. The assembly as claimed in claim 1 wherein each of the top and bottom halves is integrally molded of a resilient polymeric material.

9. The assembly as claimed in claim 1 wherein each of the top and bottom halves is made of polypropylene.

10. The assembly as claimed in claim 2 wherein each of the tabs has a shank extending to a tang at a free end of the tab, the shank having a planar surface which defines an undercut with the tang and wherein each of the bosses includes a central longitudinal axis and at least one flange having a surface directed to the central longitudinal axis and wherein each tab is snapped into the respective slot by the momentary yielding of the tab is pushed into the respective slot, each undercut engaging and being retained by the respective flange with the surface of the flange being closely adjacent to the planar surface of the shank to connect the top and bottom halves together.

11. The assembly as claimed in claim 10 wherein each boss has a first pair of opposed flanges with rectilinear surfaces, the flanges being directed toward the longitudinal axis of the boss and wherein the top half includes a second tab substantially identical to the first tab and projecting downwardly from the top support panel at each of the top corners, wherein first and second shanks of the first and second tabs at each of the top corners have a pair of parallel planar surfaces defining parallel undercuts with their respective tangs, said undercuts engaging and being retained by the first pair of opposed flanges with the rectilinear surfaces of the flanges being closely adjacent to the planar surfaces of the shanks when the first and second tabs are snapped into their respective slot at each of the bottom corners.

12. The assembly as claimed in claim 11 wherein each boss has a second pair of opposed flanges with rectilinear surfaces, the second pair of flanges being directed toward the axis of the boss and wherein the top half includes third and fourth tabs substantially identical to the first and second tabs and projecting downwardly from the top support panel at each of the top corners, the third and fourth tabs having a pair of parallel planar surfaces defining parallel undercuts with tangs of the third and fourth tabs, the undercuts being engaged and retained by the second pair of opposed flanges with the rectilinear surfaces of the second pair of opposed flanges being closely adjacent to the parallel surfaces of the shanks of the third and fourth tabs when the third and fourth tabs are snapped into their respective slot at each of the bottom corners.

13. The assembly as claimed in claim 10 or claim 11 or claim 12 wherein each of the tabs includes an outwardly radially extending support flange which defines a respective undercut with the respective tang and planar surface of the respective shank.

14. The assembly as claimed in claim 1 wherein a top surface of the top support panel is grained.

15. The assembly as claimed in claim 6 wherein the bottom half further includes a plurality of spaced support members projecting upwardly from the base and wherein the top half further includes a plurality of complementarily-spaced support pads projecting downwardly from the top support panel, the support members supporting the top support panel at the support pads and wherein the intermediate joints protect the support pads and support members at intermediate positions between adjacent corners of the pallet assembly.

16. The assembly as claimed in claim 15 wherein each of the support members is cross-shaped in cross-section.

17. The assembly as claimed in claim 11 wherein each of the bosses is shaped like a truncated pyramid.

* * * * *